US007025476B2

(12) United States Patent
Leadford

(10) Patent No.: US 7,025,476 B2
(45) Date of Patent: Apr. 11, 2006

(54) PRISMATIC REFLECTORS WITH A PLURALITY OF CURVED SURFACES

(75) Inventor: Kevin F. Leadford, Evergreen, CO (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 10/423,120

(22) Filed: Apr. 25, 2003

(65) Prior Publication Data

US 2004/0218392 A1 Nov. 4, 2004

(51) Int. Cl.
*F21V 7/08* (2006.01)
*F21V 13/04* (2006.01)

(52) U.S. Cl. ..... 362/309; 362/296; 362/327; 362/334; 362/348; 362/350

(58) Field of Classification Search ..... 362/296–300, 362/309, 327, 334–338, 340, 346, 348, 302, 362/304, 350

See application file for complete search history.

(56) References Cited

U.S. PATENT DOCUMENTS

| | | | | |
|---|---|---|---|---|
| 563,836 | A | 7/1896 | Blondel et al. | |
| 736,535 | A * | 8/1903 | Mygatt | 362/334 |
| 823,620 | A * | 6/1906 | Mygatt | 362/340 |
| 981,576 | A * | 1/1911 | Kraatz | 362/340 |
| 988,488 | A * | 4/1911 | Mygatt | 362/340 |
| 1,092,114 | A * | 3/1914 | Mygatt | 362/337 |
| 1,905,829 | A * | 4/1933 | English | 362/340 |
| 2,818,500 | A | 12/1957 | Franck | |
| 2,887,568 | A | 5/1959 | Franck | |
| 3,825,742 | A * | 7/1974 | Levin | 362/296 |
| 4,173,037 | A | 10/1979 | Henderson, Jr. et al. | |
| 4,218,727 | A * | 8/1980 | Shemitz et al. | 362/297 |
| 4,277,821 | A * | 7/1981 | Sassmannshausen | 362/346 |
| 4,839,781 | A | 6/1989 | Barnes et al. | |
| 5,143,446 | A | 9/1992 | Barnes et al. | |
| 5,444,606 | A | 8/1995 | Barnes et al. | |
| D367,337 | S | 2/1996 | Barnes et al. | |
| 5,592,582 | A * | 1/1997 | Oparin et al. | 362/304 |
| 5,971,569 | A * | 10/1999 | Smith et al. | 362/304 |
| 6,244,731 | B1 * | 6/2001 | Koiko et al. | 362/297 |
| 6,494,596 | B1 * | 12/2002 | Burroughs | 362/348 |

FOREIGN PATENT DOCUMENTS

EP 250191 A2 * 12/1987

OTHER PUBLICATIONS

Holophane Part No. 6625, Sheet 1 of 1, Aug. 15, 1977.
Holophane Part No. 6635-A, Sheet 1 of 1, May 24, 1966.

* cited by examiner

*Primary Examiner*—Alan Cariaso
(74) *Attorney, Agent, or Firm*—Kilpatrick Stockton LLP; John S. Pratt; Geoffrey K. Gavin

(57) ABSTRACT

A substantially bell-shaped light fixture component for use with a lighting fixture, the light fixture component having upper and lower openings and curved or undulating segments on the light fixture component body that diffuse light from the light source used in connection with the light fixture component. The outer surface of the light fixture component body also has a plurality of curvilinear prisms for reflecting light by internal prismatic reflection. The inner and outer surfaces of the light fixture component create an even distribution of light that emanates from the light fixture component in use.

23 Claims, 11 Drawing Sheets

PRISMATIC REFLECTORS WITH A PLURALITY OF CURVED SURFACES

BACKGROUND

1. Field of the Invention

This invention generally relates to light fixture components for lighting fixtures. In specific embodiments, the invention relates to a reflector for use with an overhead light source that includes a plurality of undulations or curves in the vertical dimension on at least a portion of its inner and outer surface. These undulations serve to diffuse light that emanates from the light source. The outer surface of the reflector also includes a plurality of prisms for internal prismatic reflection.

2. Description of the Related Art

There are various reflectors available for use with overhead lighting fixtures, particularly for commercial, industrial, institutional and residential lighting purposes. It is often desirable for these reflectors to reflect light from a light source located within the reflector to produce even illumination of a plane. The term "reflector" has traditionally been used to refer to metal reflectors, which are reflectors in the true sense of the term—in that they reflect light incident to their exposed surface, are opaque, and are not capable of transmitting light. For example, some conventional reflectors provide the desired light distribution by featuring opaque reflective surfaces that do not transmit rays.

In recent years, however, the term "reflector" has also been used to refer to transparent devices that incorporate structures such as prisms, so that the devices reflect as well as refract light. Transparent devices without the modified surface structures would only refract light, and would not be useful as reflectors. The term "reflector" or "light fixture component" is used in this patent to refer to this second type of reflector and the phenomenon of the reflecting that occurs, referred to as "total internal reflection." The principals of refraction and total internal reflection combine to mimic the behavior of an opaque reflector. For example, some transparent reflectors provide prismatic reflection through the use of 90-degree prisms or external prismatic surfaces that are a combination of 90-degree and curved prisms. The reflection only occurs for light entering from within a small zone. This is illustrated by the schematic at FIG. 11. As those of ordinary skill in the art will recognize, if a light source is larger than a particular size, some light will pass through the reflector because light will strike the inner surface of the reflector at an angle that does not result in total internal reflection at both exterior prism faces. In other words, outside that zone, the light will be refracted and transmitted rather than undergo total internal reflection; however, the transmitted light may be useful as uplight.

One challenge faced by designers of reflectors is that it is difficult to create a design that works well with many different sizes and types of lamps and lamp positions. Such a versatile design is typically preferred from the manufacturer's standpoint because there is less tooling involved and fewer inventory control issues. This in turn may allow the manufacturer to offer the reflector at a reduced price, providing cost savings to the end user.

The shape and size of a particular reflector is often driven by the shape and size of the light source with which it is to be used. For example, luminaire housings employing linear sources such as fluorescent lamps tend to be linear or square. Point sources are often used in connection with reflectors that are surface of revolution or bell-shaped.

It has also been found that the use of 90-degree prisms in connection with transparent reflectors is particularly efficient for situations such as industrial lighting applications. Ninety-degree prisms typically allow only a small percentage of light to pass through the reflector (although some light naturally passes through the reflector, primarily as a result of originating too far off axis as described above).

Ninety degree prisms disposed on the outside surface of reflectors have been used for several decades. See e.g., U.S. Pat. Nos. 365,974, 563,836, and 4,839,781, which are all hereby incorporated by this reference. The use of such prisms is an effective optical control technique. Prisms have been disposed vertically on outer reflector surfaces, as well as horizontally. Additionally, in order to enhance the optical control, the interior surfaces of reflectors may be smooth, vertically fluted, textured, or stepped with interior contours to help direct light to the prism faces.

Prisms may be provided in various materials, such as glass, plastic, or acrylic. An acrylic prism approach is advantageous primarily because of its high efficiency. The acrylic absorbs very little light as it passes through. When light enters from within the reflection zone, it is reflected with significantly higher efficiency than a typical aluminum anodized reflector. The acrylic design naturally creates an uplight component that is often desirable as well. Uplight reflects from the ceiling, thereby reducing the contrast between the bright light source and its background. This reduces the potential for glare, softens shadows, and generally makes for a better lighting condition. Another advantage of an acrylic reflector is that it glows all over. This effectively increases the size of the light source from a glare perspective.

Another factor that designers of reflectors must consider is that the size of the light source dictates the size of the zone into which light is reflected. In many cases, the use of a large light source creates a "hot spot." The light from the source is reflected by the reflector due to total internal prismatic reflection and directed predominantly toward a single narrow zone below the light source, i.e., the zone encompassing "nadir." (Similarly, if the device were inverted, the same phenomenon could force the light to be directed predominantly toward a single, narrow zone above the light source, i.e., the zone encompassing "zenith.") In both cases, this phenomenon creates an undesired "hot spot" directly below or above the light fixture. Even a small amount of light can result in a significant candela spike at these locations due to axial symmetry.

The uppermost portions of the reflector tends to contribute most to the hot spot due to that portion's proximity to the lamp and also because the uppermost portion is curved or "aimed" inward. The result is that light that is internally reflected from the upper portion of the reflector is projected toward nadir.

Existing bell-shaped reflectors have a tendency to reflect or redirect light toward the axis of revolution, resulting in a disproportionately large contribution of light at nadir relative to directions outward and away from the axis of revolution. This causes a spike in the intensity distribution of the reflector, a "hot spot," which prevents even illumination. A reflector that creates a "hot spot" will present a light puddle, or an undesirable bright area of illumination directly beneath the luminaire when compared with the entire surface that is being illuminated.

There have been numerous attempts to avoid the problem of hot spots, although some have been more effective than others. For example, efforts have been made to texture the inner surface of reflectors (for example, by sand blasting, acid etching, or peening), but these efforts often result in greater manufacturing expense. They may also result in a general diffusion that causes a greater percentage of light to transmit through the reflector body while reducing the downlight efficiency of the luminaire.

Additional efforts include providing "stepped" interior contours to alter the direction of the reflected light in the vertical dimension only, however this method requires more plastic than other methods. Reflectors having such a "stepped" inner surface were analyzed and also found to change the direction of light, thereby increasing sensitivity with respect to lamp position. Designs that primarily diffuse light by sending it into a broad vertical zone, rather than additionally altering the direction are preferable because they can accommodate a broader range of lamp types and positions. Additionally, the stepped inner surface of the prior art reflectors includes steps only on the uppermost, inside portion of the reflector creating a discontinuity of appearance in the vertical direction. These steps are not provided over the entire interior surface of the reflector and are not present on the outer surface, thereby increasing the amount of plastic required to maintain a minimum wall thickness.

Accordingly, there remains a need in the art for a reflector that alleviates the above-described hot spots, while maximizing the amount of reflected light and minimizing the amount of plastic required. The improvements offered by the present inventors help alleviate the problems described in ways not addressed by the prior art.

SUMMARY

The reflectors of this invention are designed to receive upward-directed light and reflect it downward. Alternatively, other embodiments can receive downward-directed light and reflect it upward, or reverse the direction of light from any direction, including from the side. For the sake of convenience, the remainder of this patent will focus on embodiments designed to receive upward-directed light, although it should be understood that the invention is not so limited.

It is necessary for the reflector to reflect (through internal prismatic reflection) and refract light in a manner that distributes the light appropriately for the intended lighting task. Reflectors according to certain aspects of this invention include a reflector body that is shaped generally like an inverted, bottomless bowl with a series of 90° prisms that are disposed vertically forming the outside surface of the bowl. The multiple prisms are provided in order to limit the amount of light that passes from the light source directly through the reflector and to reflect it appropriately through internal prismatic reflection.

The prisms generally feature two flat sides that meet at the prism peak. The more a prism angle deviates from 90°, the more light is allowed to pass through the reflector. Thus, it is desirable that the prisms approximate, as close as possible in light of manufacturing considerations, a 90° valley and a 90° peak between and for each prism with respect to the light source. Accordingly, the prisms are configured so that the majority of light from the light source undergoes total internal reflection on each face of the exterior prisms.

In order to efficiently provide uniform light distribution and diffusion below the light source and eliminate the "hot spot" described above, reflectors according to certain aspects of this invention are provided with at least an upper portion of the inner and outer surface comprising a plurality of undulations or curved portions in the vertical dimension. The curved portions preferably run sequentially along the surface (and intersect one another) over a substantial portion of the reflector body, with the curved portions having a less pronounced curvature toward the lower portion of the reflector. The curved portions are adapted to help diffuse light from the light source when the reflector is in use.

The curved portions may also be referred to as "undulations" or "convex/concave undulating segments." In a specific embodiment of the invention, the undulations, convex/concave undulating segments, or curved portions are repeating, aligned, elliptically curved segments that define the reflector body and maintain a minimum wall thickness between the inner surface of the reflector and the valleys of the major and minor prisms.

Another way to conceptualize the invention is that the reflector body is a curve that defines a major bell-shaped contour of the reflector, with the major bell-shaped contour defined by a series of minor contours that define elliptical segments in the vertical dimension over the inner and outer surface of the reflector, wherein the elliptical segments lessen in depth as they extend down the reflector.

Throughout this patent and for ease of description, the curved portions, undulations, or convex/concave undulating segments will simply be referred to as "segments." Additionally, "segments" refer to curved segments or repeating, aligned, curved segments. These segments help prevent light from being reflected down and concentrated at an area directly beneath the fixture (the nadir) and forming a "hot spot," because they work in conjunction with the externally disposed prisms to diffuse the light in the vertical dimension. The segments allow the light to be reflected downward in a variety of pitches, depending upon the direction and location of the incident light onto a particular segment.

DETAILED DESCRIPTION

Figure 1:
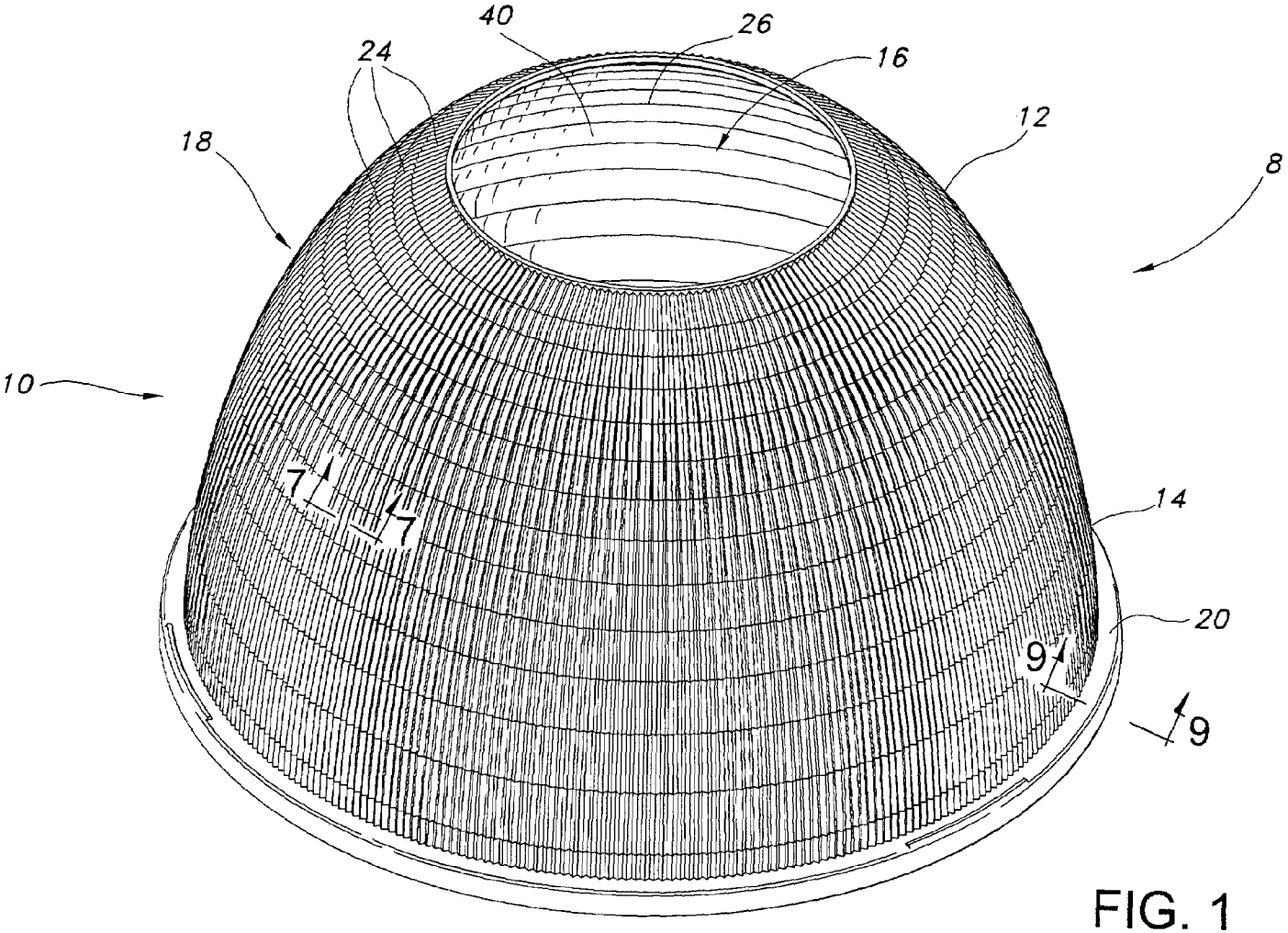
FIG. 1 is a top and side perspective view of one embodiment of a reflector of this invention.
Figure 2:
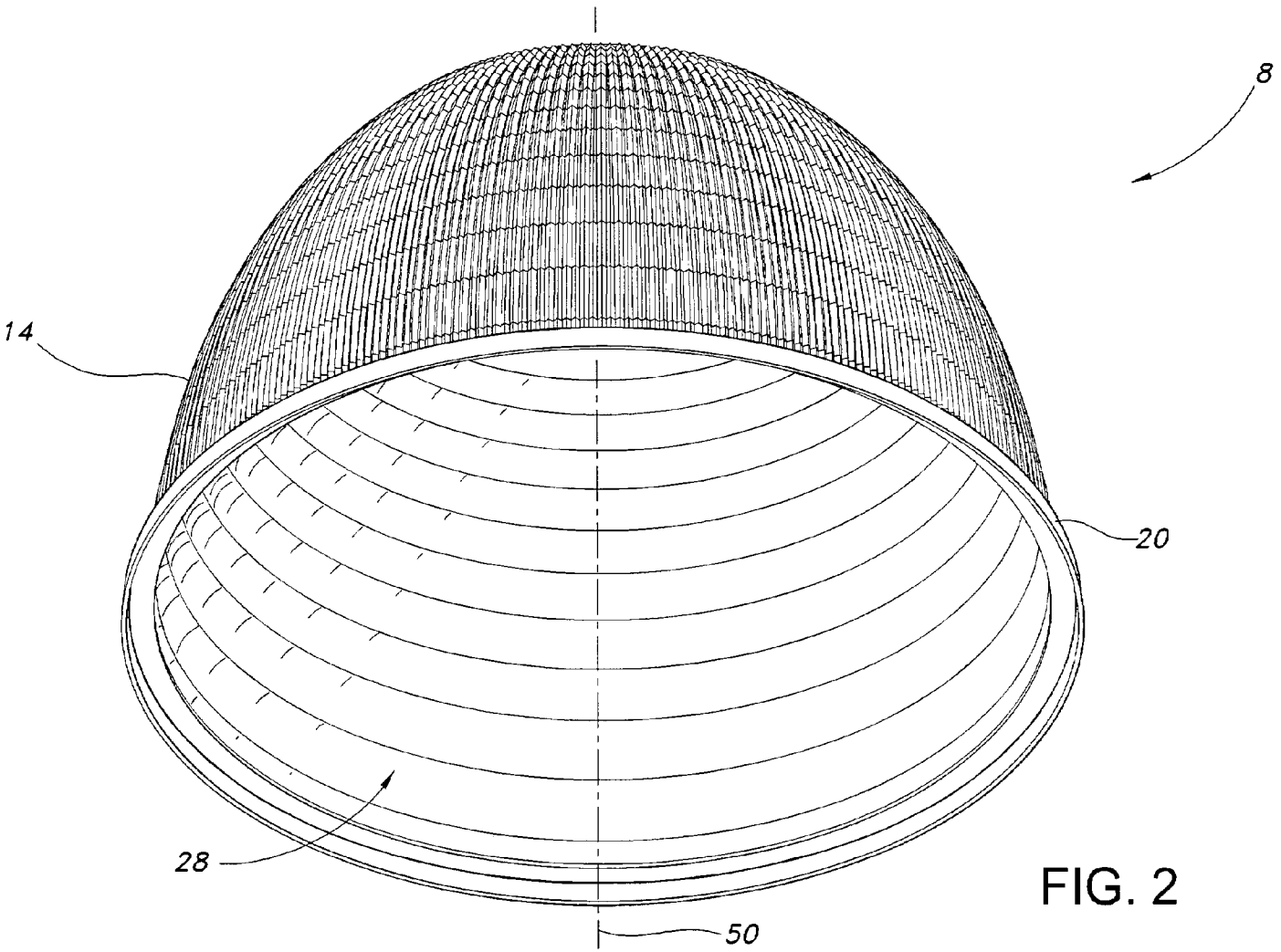
FIG. 2 is a bottom and side perspective view of the reflector of FIG. 1.

Generally, the reflectors described herein are particularly designed for use with large overhead light sources. As shown in FIGS. 1–5, reflector 8 according to certain aspects of this invention includes a reflector body 10 for use with a light source or lamp (not shown). The reflector body 10 is preferably bell-shaped and particularly resembles an inverted bottomless bowl. The reflector can be usefully described by reference to the azimuthal (horizontal) and vertical dimensions.

The reflector includes a series of external prisms extending down the reflector in the vertical dimension, the prisms resembling a saw-tooth configuration in the azimuthal direction. Each apex of each prism lies in the vertical direction, i.e., it follows a line running vertically on the reflector.

The reflector further includes curved segments or sections in the vertical dimension, the curves extending vertically down the reflector. The inside and outer surfaces of the reflector undulate running vertically down the reflector. Also in the vertical direction, on the outer surface, the prisms undulate corresponding to or aligned with the undulations on the inner surface. Additionally, each individual curve or undulation establishes an annular trough that runs azimuthally around the interior of the reflector.

The upper portion 12 of the reflector body 10 features an upper opening 26, and its lower portion 14 features a lower opening 28. Openings 26 and 28 are adapted to receive a light source and to provide an exit for the illumination in use, respectively. The reflector body 10 is preferably formed of a transparent material, such as plastic, glass, or any other material that is transparent or a transmissive material with an index of refraction that is greater than that of air. In particular preferred embodiments, the reflector 8 is formed of acrylic material.

The outer surface 18 reflects light that passes through the reflector body 10 by including a plurality of curvilinear prisms 24 that extend vertically along outer surface 18 between upper opening 26 and lower opening 28. Specifically, as shown in FIGS. 4–7, each prism 24 has a substantially isosceles triangular cross section with a peak 30 and a valley 32.

The angle at the peak 30 of the triangle is preferably about 90 degrees, but may vary between about 85 to about 95 degrees, and more specifically between about 87 to about 93 degrees. The prisms may have small radii at peaks and valleys due to manufacturing and tooling limitations. Each prism 24 also tapers in width from its valley 32 to its peak 30. The majority of the light from the light source is reflected by the prisms 24 back into reflector 8 and downwardly through lower opening 28 by the principle of total internal reflection, which is well known to those of ordinary skill in the art. Any number and width of prisms 24 may be provided on reflector body 10 that accommodate necessary manufacturing considerations, as long as outer surface 18 at least partially reflects light transmitted through reflector body 10.

Due to the bell-shape of reflector body 8, the number of prisms 24 at the smaller, upper portion 12 may not equal the number of prisms at the wider, lower portion 14. In order to provide for a substantially uniform prismatic outer surface 18, preferred embodiments of the present invention feature major and minor prisms.

Figure 4:
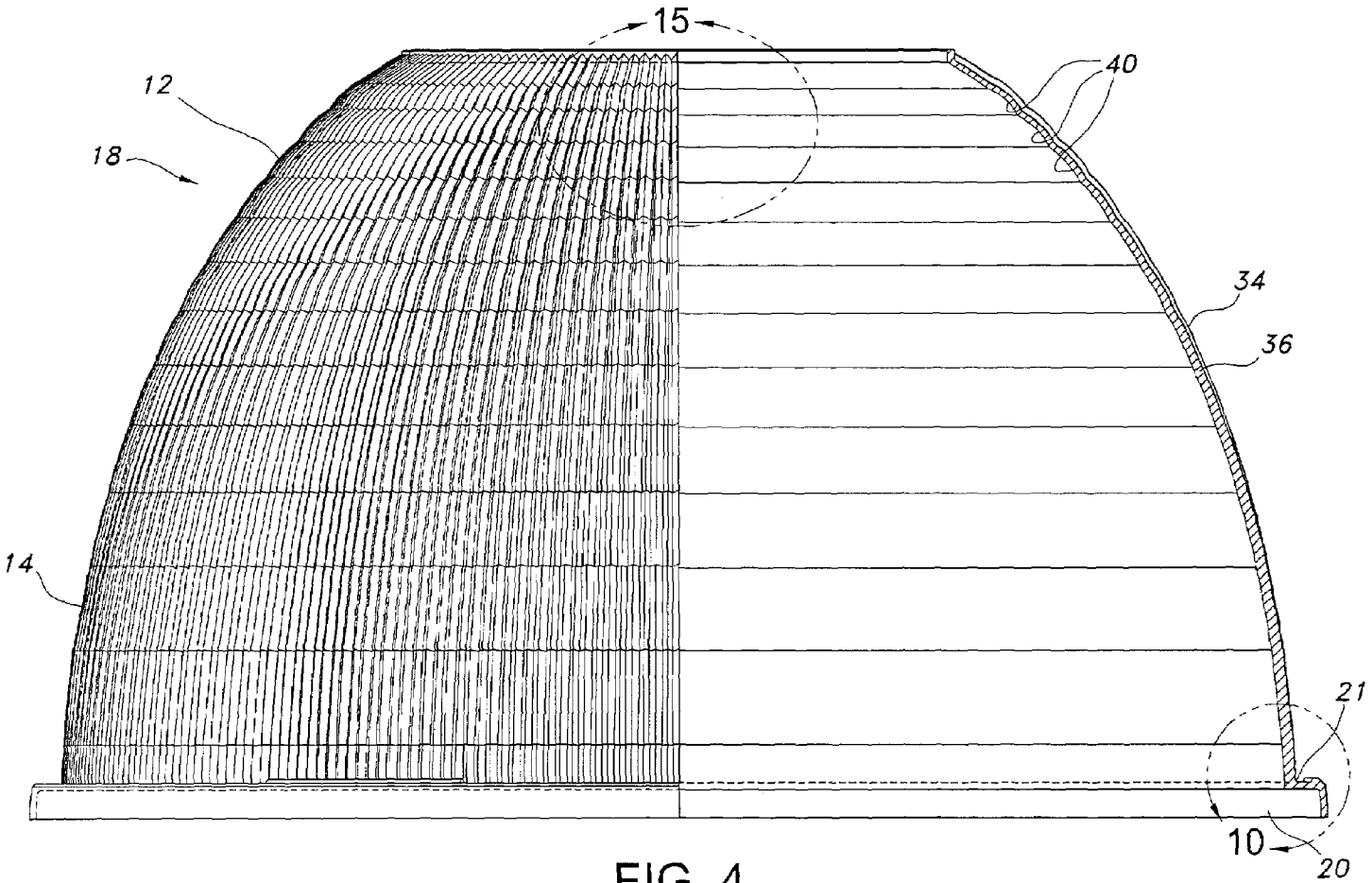
FIG. 4 is a side view of the reflector of FIG. 1 partially in section through a minor prism.

For example, as shown in FIG. 4, major prisms 34 have substantially the same depth from lower portion 14 to upper portion 12. Interspersed between major prisms 34 are minor prisms 36, preferably at a 1:1 ratio, with one minor prism 36 between each adjacent pair of major prisms 34. Minor prisms 36 start with a depth that is comparable to that of the major prisms 34 at lower portion 14 that decreases as minor prisms 36 extends toward upper portion 12. In other words, the minor prisms 36 reduce in size until they substantially disappear prior to reaching the top of upper portion 12.

Although specific dimensions for certain embodiments of the prisms are set forth in Tables 1 and 2 below, there is no requirement that the prisms be of a certain depth or width. In one embodiment, however, the minor prisms 36 have a depth that is substantially less than the depth of the major prisms 34 at the upper portion 12, a depth that is about half the depth of the major prisms 34 toward the middle portion of the reflector, and a depth that is about equal to the depth of the major prisms 34 toward the lower portion 14 of the reflector body 10.

In a specific embodiment, the number of prisms 24 on the reflector body 10 is made up of about half major prisms 34 and about half minor prisms 36. For example, if there are 320 total prisms, there are about 160 major prisms 34 and about 160 minor prisms 36.

Figure 5:
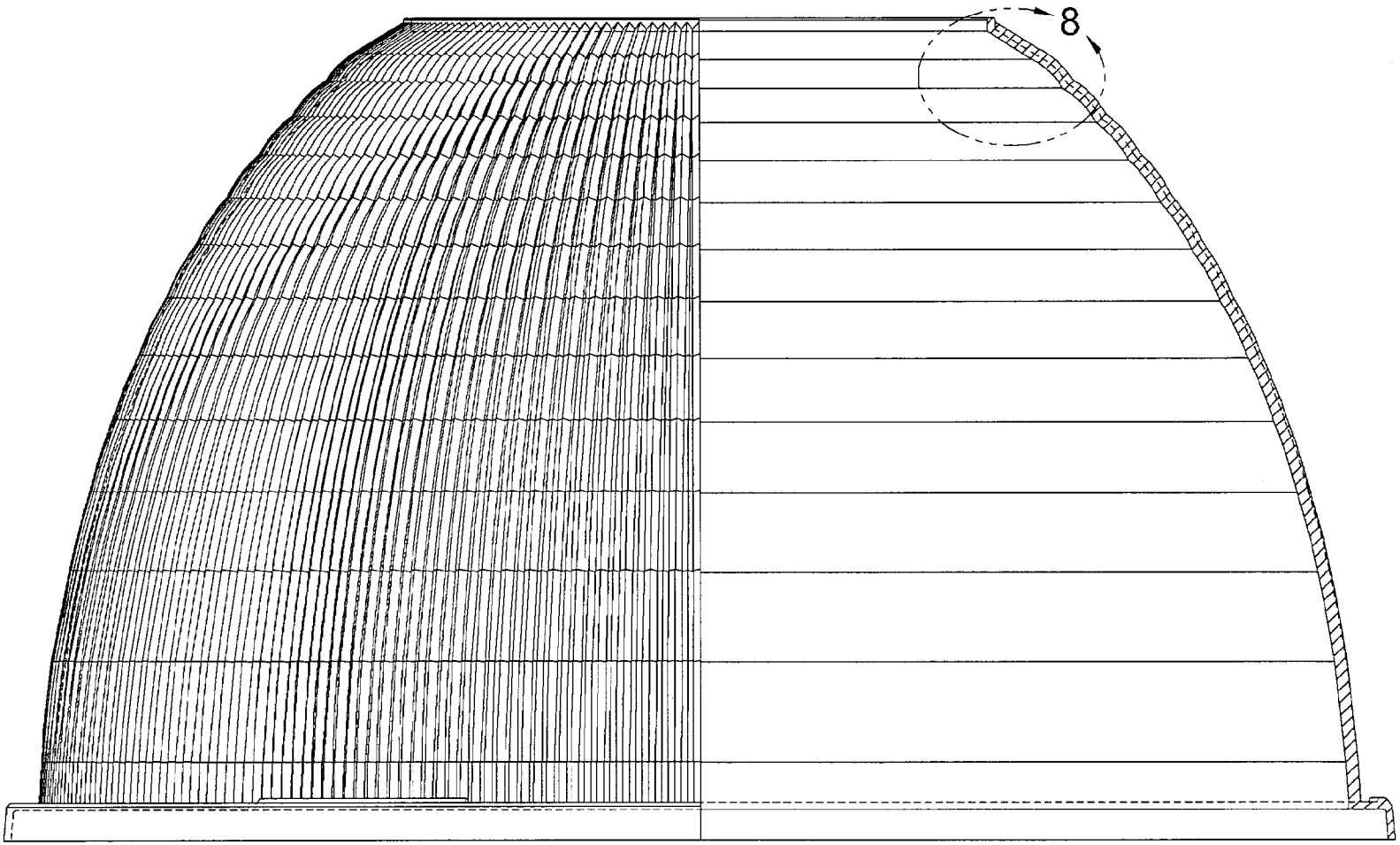
FIG. 5 is a side view of the reflector of FIG. 1 partially in section through a major prism.
Figure 7:
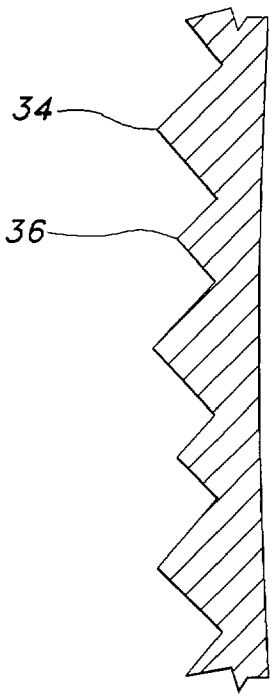
FIG. 7 is a fragmentary top plan view in section taken at line 7—7 in FIG. 1 through the prisms at the upper to middle portion of the reflector of FIG. 1.

FIG. 4 is a side view of a reflector body 10 as well as a cross-sectional view through a minor prism 36. It shows that minor prism 36 enlarges in depth as it nears the lower portion 14. Additionally, FIG. 7 shows a top plan view of a portion taken between about the upper portion 12 to the middle portion of the reflector body 10 where the depth of the minor prisms is less than the depth of the major prisms 36. FIG. 5 is a side view of a reflector body 10 with a cross-section view through a major prism 34, with the adjacent minor prism 36 shown in dotted lines. FIG. 5 illustrates that major prism 34 can maintain substantially the same depth throughout.

In certain embodiments, the design and shape of the contour is determined by an iterative method that is based upon an algorithm. The algorithm produces a vertical contour that yields the desired distribution for a true point light source within a spun metal reflector. However, the dimension of the light source is significant. Light sources used in connection with overhead lighting fixtures are often large and do not emit light the way a single point source does. Additionally, an acrylic reflector is optically different from a spun metal reflector and thus, the algorithm commonly used in the art in connection with a spun metal reflector will fail to produce the desired contour in an acrylic reflector.

Specifically, in order to account for the difference between point and area sources, an iterative approach was used. A computer algorithm was developed to construct a complete 3-dimensional geometric computer model based upon certain input parameters relating to the desired photometric distribution while remaining within certain fixed limitations such as the aperture size and overall reflector height. The resulting 3-dimensional computer model was then analyzed using a commercially available ray-tracing program and these results were compared to the desired distribution to establish the input parameters for each subsequent run. Through iteration, the design was found to converge on the desired distribution.

Generally, because the critical angle for total internal reflection of acrylic is approximately 42-degrees in air, 90-degree prisms can be used on the outer surface of reflectors to reflect light rather than refract light, as long as the light source is relatively small in the lateral dimension. Note that although the vertical dimension of the light source has little impact on the percentage of light that undergoes total internal reflection, it does contribute to the creation of the hotspot described previously. A source that is larger in the vertical dimension will have a greater probability of creating a hot spot at nadir. Put another way, when light is reflected to remote locations, only a small circumferential segment of the reflector reflectively images the source. However, as the light is reflected toward nadir, the whole circumference of the reflector reflectively images the source, and at nadir, even a small amount of light can cause a large candela spike.

Figure 11:
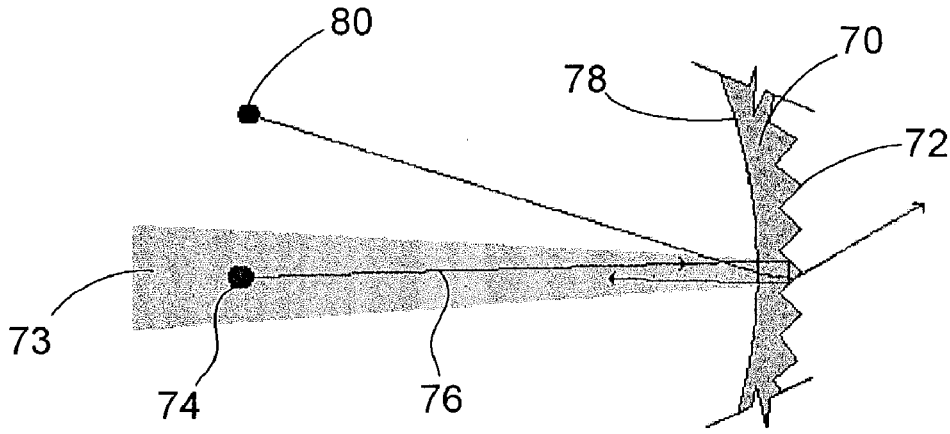
FIG. 11 is a schematic view of light being refracted and undergoing total internal reflection to effectively reflect the light.

For example, the schematic shown at FIG. 11 depicts total internal reflection. The light in the gray zone 73 will be reflected because the zone 73 defines the boundary for total internal reflection. As the source grows in diameter, all light that originates outside the zone, e.g., at area 80, will be transmitted and all light that originates within the zone 73 will be reflected. Thus, the percentage of light that gets reflected vs. transmitted is dictated by the diameter of the source. When the light source is not a point source, but a large light source with light emanating from an area broader than the reflecting zone, some of the light will contact the reflector at a less than desired angle, and light will transmit through the reflector, rather than be reflected downward.

For example, the reflector 70 is a section of circular glass or acrylic reflector with 90-degree prisms 72 on its exterior surface. The light source 74 in the center of the reflector 70 emits light. Specifically, light 76 enters the first surface 78, refracts a small amount, reflects off of the two 90-degree prism faces 72, and refracts once more when exiting the interior surface 78. As shown, the light is essentially reflected back in the direction from which it came in two dimensions. The behavior in the third dimension is most similar to that of a mirror. The result is that glass (which is a material that alone, would act as a refractor to transmit light) behaves like a mirror (within certain limits of course) by providing internal prismatic reflections. A primary advantage compared to first surface reflection using opaque reflectors is that very little light is absorbed in the process.

However, light entering from outside the small point source zone 73, such as light originating at point 80, will pass through the exterior prism 72 rather than undergoing total internal reflection. This example illustrates the importance of properly orienting and precisely positioning the 90-degree prisms with respect to the light source. As the sides of the prism either diverge or converge relative to 90-degrees with respect to the light source, the gray zone 73 (the zone in which light undergoes total internal reflection) shown in FIG. 11 becomes smaller. At roughly 84-degrees and 96-degrees, based on the refractive index of acrylic, the zone diminishes and the utility of the prism is sacrificed.

Thus, in order to appropriately orient the prism to provide the most effective dispersion of the light, reflectors 8 further include at least an upper portion of the inner surface and outer surface that include a plurality of undulating segments 40. One benefit of providing the segments 40 of the present invention is that they permit only a small amount of the segment 40 to reflectively image light directly at nadir.

For example, FIGS. 4 and 5 show a series of segments 40 that comprise reflector body 10 that are curved portions defining the inner surface 16 and the outer surface 18 of the reflector body 10. The concave undulating segments or curved portions will be referred to generally as segments 40. The segments 40 preferably run consecutively and vertically down the reflector body 10. Each segment 40 is preferably adjacent to another segment 40 over a substantial portion of the reflector body 10, with the segments 40 having a lesser curvature toward the lower portion of the reflector.

Segments 40 may be elliptical segments, curved segments, undulating segments, concave undulating segments, arc segments, circular segments, line segments, concave-shaped segments, scallop-shaped segments, or partial annular undulations. The purpose of segments 40 is to help diffuse light in the vertical dimension from the light source when the reflector is in use. Segments 40 help prevent light from being reflected straight down and concentrated at an area directly beneath the fixture (the nadir) and forming a "hot spot" by diffusing the light in the vertical dimension. The segments 40 allow the light to be reflected downward in a variety of pitches, depending upon where the light hits the particular segment. This is illustrated schematically by FIG. 12. Put another way, the segments allow the light to be dispersed over a broader zone for a more even, effective, and pleasing light distribution. The use of segments 40 on the inner and outer surfaces is also economically efficient because they use less material than other "hot spot" solutions explored to date.

Figure 8:
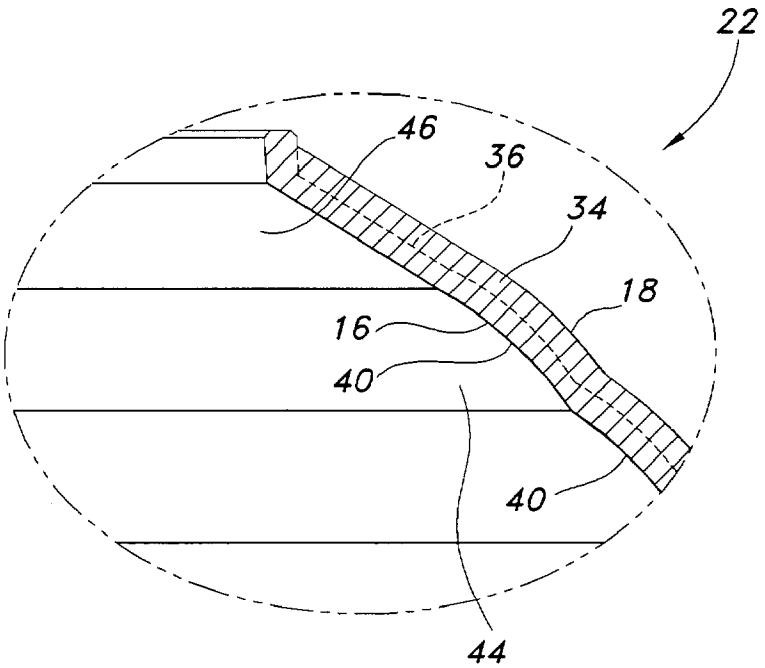
FIG. 8 is an enlarged detail view of an undulated segment 8 from FIG. 1.

Segments 40 are shown in FIGS. 4 and 5 and in enlarged detailed view in FIG. 8. Segments 40 are located on the outer surface 18 and the inner surface 16 of reflector body 10. They are also shown as substantially aligned with one another, to create a substantially uniform wall thickness, i.e., each segment 40 on the outer surface 18 corresponds to a segment 40 on the inner surface 16.

In a particular embodiment, segments 40 are elliptical segments. In other words, segments 40 define a portion of reflector body 10 that comprises a series of small portions of ellipses, small portions of which are manifested in scallop-type shaped curves or segments 40 that are disposed on the reflector body 10. These elliptical or ellipsoidal segments 40 may be described as repeating, aligned, elliptically curved segments.

Figure 12:
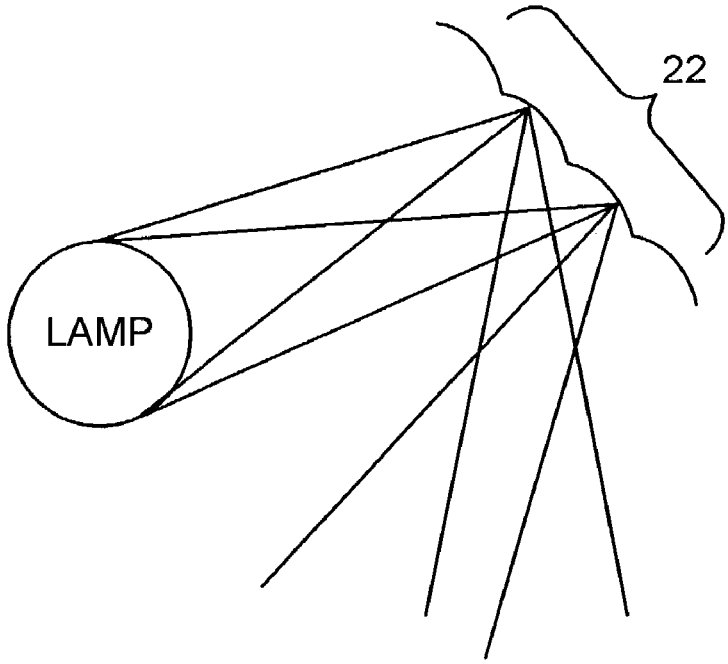
FIG. 12 is a schematic view of light being dispersed by curved segments according to certain aspects of this invention.
Figure 14:
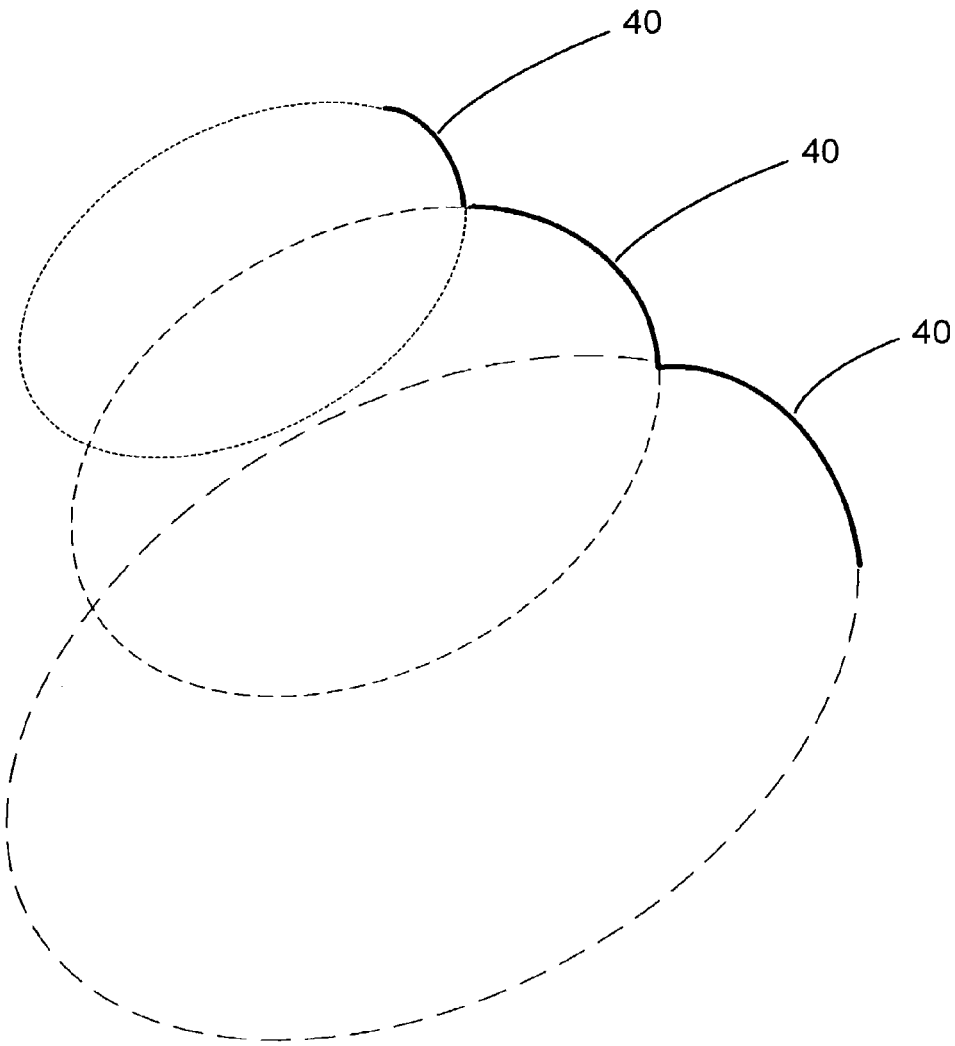
FIG. 14 is a schematic view of a series of ellipses, portions of which make up an elliptically-shaped section in reflectors of this invention.
Figure 15:
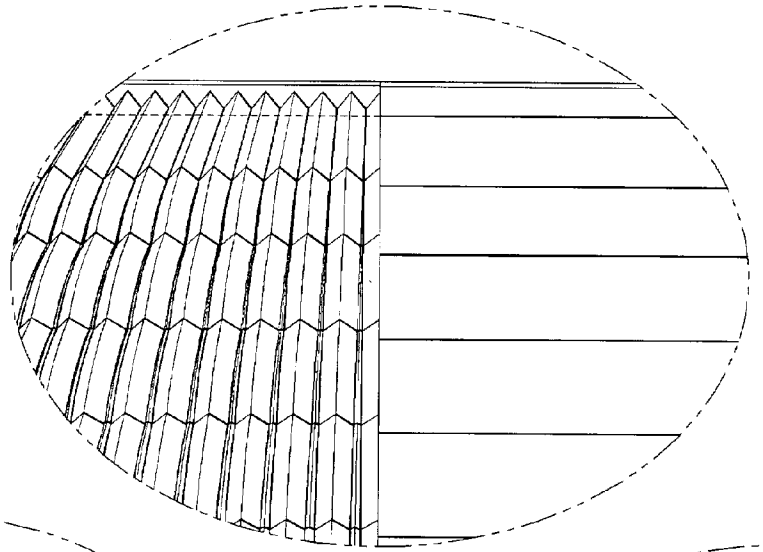
FIG. 15 is a close-up view taken from the circle 4 in FIG. 4.

FIG. 12 is an exaggerated schematic that shows the effect of elliptical segments 40, and FIG. 14 shows an exaggerated schematic showing elliptical segments 40 as they are manifested on inner 16 and outer 18 surface of reflector body 10 (These schematics are greatly simplified versions shown for illustration only. The prisms that are on the outer surface of the reflector 10 are not shown for the sake of clarity, but the prisms are the features actually causing the light to be reflected through internal prismatic reflection. The segments 40 are what allow the light to be diffused to various positions below the light source.) The segments 40 allow the light to be reflected downward in a variety of pitches, depending upon the location and associated angle of incidence at which the light strikes the particular segment 40.

Figure 6:
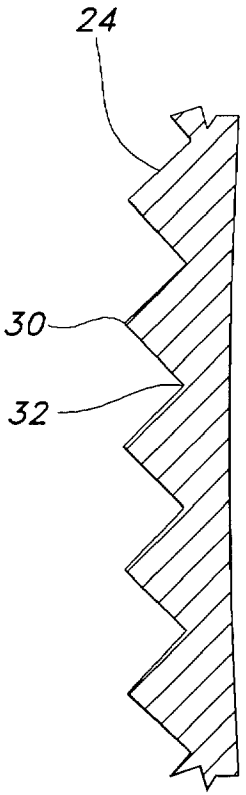
FIG. 6 is a top plan view of prisms at the lower portion of the reflector of FIG. 1.
Figure 10:
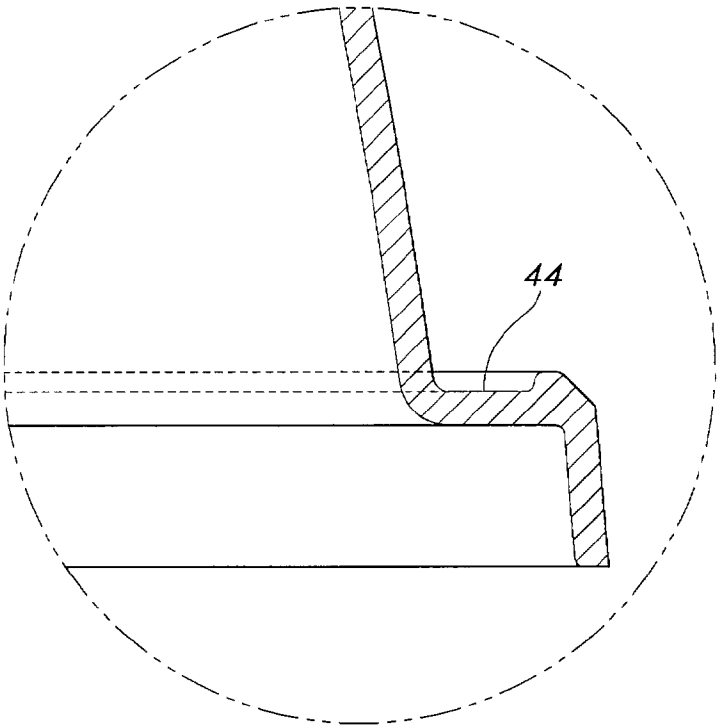
FIG. 10 is a side vertical section view of an enlarged detail taken at circle 10 in FIG. 2.
Figure 9:
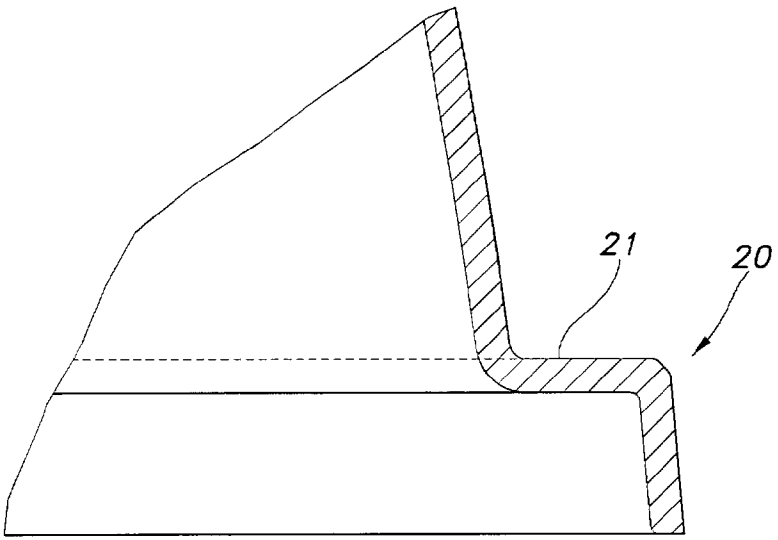
FIG. 9 is a side vertical section view of the lower lip of the reflector of FIG. 1.

In a specific embodiment of the invention, the segments 40 (whether they are undulating segments, curved segments, elliptical segments, repeating, aligned, elliptically curved segments, concave undulating segments, arc segments, circular segments, line segments, concave-shaped segments, scallop-shaped segments, or undulations) define the reflector body and maintain a substantially constant wall thickness between the inner surface and each prism valley, as shown in FIGS. 6 and 7. This feature helps save material costs by reducing the amount of reflector material needed to form a reflector 8, while maintaining a substantially constant minimum wall thickness, which is necessary to the integrity of the reflector 8.

Another way to conceptualize the segments 40 of this invention is that the reflector body 10 is a curve that defines a major bell-shaped contour of the reflector, with the major bell-shaped contour defined by a series of minor contours or segments 40 that define the inner and outer surface of the reflector, wherein the segments lessen in depth as they extend down the reflector. Again, however, it is preferred that the segments maintain a substantially constant wall thickness between inner surface and prism valleys.

As briefly mentioned, and as shown in FIGS. 4 and 5, it is preferable that the segments 40 have the highest degree of curvature or depth near the upper portion 12 and fade away completely or fade to almost no visible curvature toward the lower portion 14. FIGS. 4 and 5 show that segments 40 appear to "flatten out" as they reach lower portion 14. Toward upper portion 12, segments 40 curve outward from reflector body 10.

One theory behind the orientation of the segments 40 of this invention is that the upper portion 12 of inner surface 16 is a particular problem area in causing a hot spot in a bell-shaped style reflector. This is partially due to its proximity to the light source and partially because upper portion 12 is curved such that it aims toward nadir, i.e., the light reflected by this portion is predominately directed downward. Specifically, more light is reflected downwardly (by internal prismatic reflection) by the outer prismatic surface 18 at the upper portion 12 than at the lower portion 14, because the lower portion 14 is spaced further from the light source and is generally aiming to a higher vertical angle. Providing curved segments 40 over at least a portion of the surface of the upper portion 12 allows light from the light source to be dispersed more evenly, rather then being concentrated at the nadir 50 and forming a hot spot.

Figure 17:
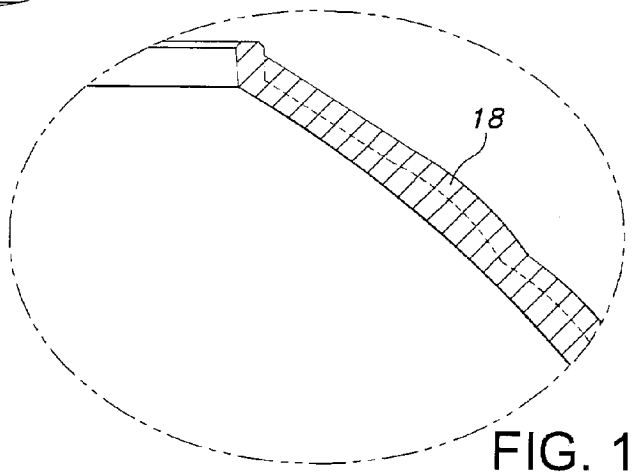
FIG. 17 is an enlarged detail view similar to FIG. 8 of another embodiment of a segment.
Figure 16:
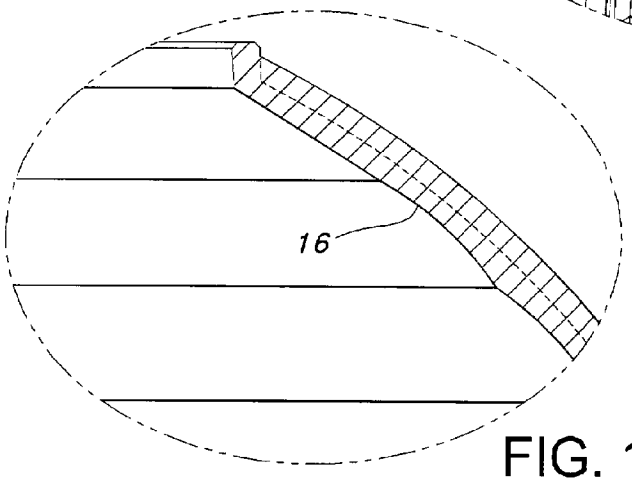
FIG. 16 is an enlarged detail view similar to FIG. 8 of an alternate segment.

Additionally, providing segments 40 on both the inner surface 16 and the outer surface 18 of the reflector body 10 has been found to allow efficient light dispersion while requiring the least amount of material. Alternatively, the segments 40 may be included only on the inner surface 16, as shown in FIG. 16 or on the outer surface 18, as shown in FIG. 17. It is preferred, however, that the segments 40 be provided at least on the outer surface 18 for maximum effect, although additional aligned curved segments 40 on the inner surface 16 help save material.

The primary purpose of segments 40 is to direct the light coming from the light source away from the nadir in a substantially conical shape around the nadir to prevent the light from being concentrated downwardly and creating a hot spot below the fixture. In addition, varying the location of the light source with respect to the segments 40 should not create a hot spot or a void that would disrupt even illumination because the light is directed into a much broader zone than it would ordinarily be if no segments were present. Therefore, precise location of the light source is not required in connection with reflectors according to certain embodiments of this invention, minimizing sensitivity to lamp position and manufacturing tolerances. In fact, the present design is highly forgiving with respect to lamp positioning. Multiple light sources and multiple lamp positions can be used while also achieving a good distribution.

Segments 40 may extend over the entire inner surface 16 and the outer surface 18 as shown by FIGS. 1–5, although the Figures also show that the segments 40 lessen in curvature toward the lower portion 14. In other words, this means that the segment 40 is curved more, has a greater depth, or is a tighter curve at the upper portion 12 and is curved less, has a shallower depth, or is a looser curve at lower portion 14. As illustrated schematically by FIG. 14 in connection with an elliptical segment 40, the ellipses become larger as they extend down the reflector body 10 so that there is a less pronounced curve toward lower portion 14.

Segments 40 also serve an aesthetic function in terms of obscuring the light source when it is viewed through the acrylic at high angles, thereby reducing the potential for glare. Incorporating segments 40 substantially down the reflector body 10 helps to obscure the light source, even as the segments lessen in curvature. The segments 40 additionally provide a way to compensate for shortcomings in the distribution resulting from the external prism contours alone.

Alternatively, rather than providing segments 40 that extend over most of reflector body 10, segments 40 may only be included at upper portion 12 of reflector body 10. This embodiment will still provide many of the advantages described above because, as mentioned, the upper portion 12 is a particular problem area in causing a hot spot due to its proximity to the light source and because it is curved to aim toward nadir.

Segments 40 may take on any dimensions as long as they provide the effect of light dispersion. As shown in FIG. 1, segments 40 may take the form of individual curved bands that encircle or form reflector body 10 in the lateral or azimuthal direction. The segments 40 are vertical contours that are not frusto-conical or frusto-toroidal segments. Rather, on the inner surface, they are single, continuous curved bands that extend around the reflector body 10. On the outer surface, the segments 40 help define undulating prisms. In a specific embodiment, the dimensions of each curved band include a portion of an ellipse. Alternatively, the dimensions of each curved band resemble a slight scallop.

Examples of elliptical segment 40 dimensions for very specific embodiments are provided in Tables 1 and 2, although these dimensions are provided as examples only and are not intended to be limiting in any way. The Tables are provided in order to show one way that the size and shape of the ellipses can be calculated. The values provided in Tables 1 and 2 below define full ellipses, although very small portions of each ellipse make up each segment 40. It is emphasized that the Tables are provided only as possible examples of embodiments and sets of dimensions that can be used to manufacture a reflector with elliptical segments 40. It should be understood that any dimensions defining an arc, a curve, an ellipse or any other segment are considered within the scope of this invention.

Figure 13:
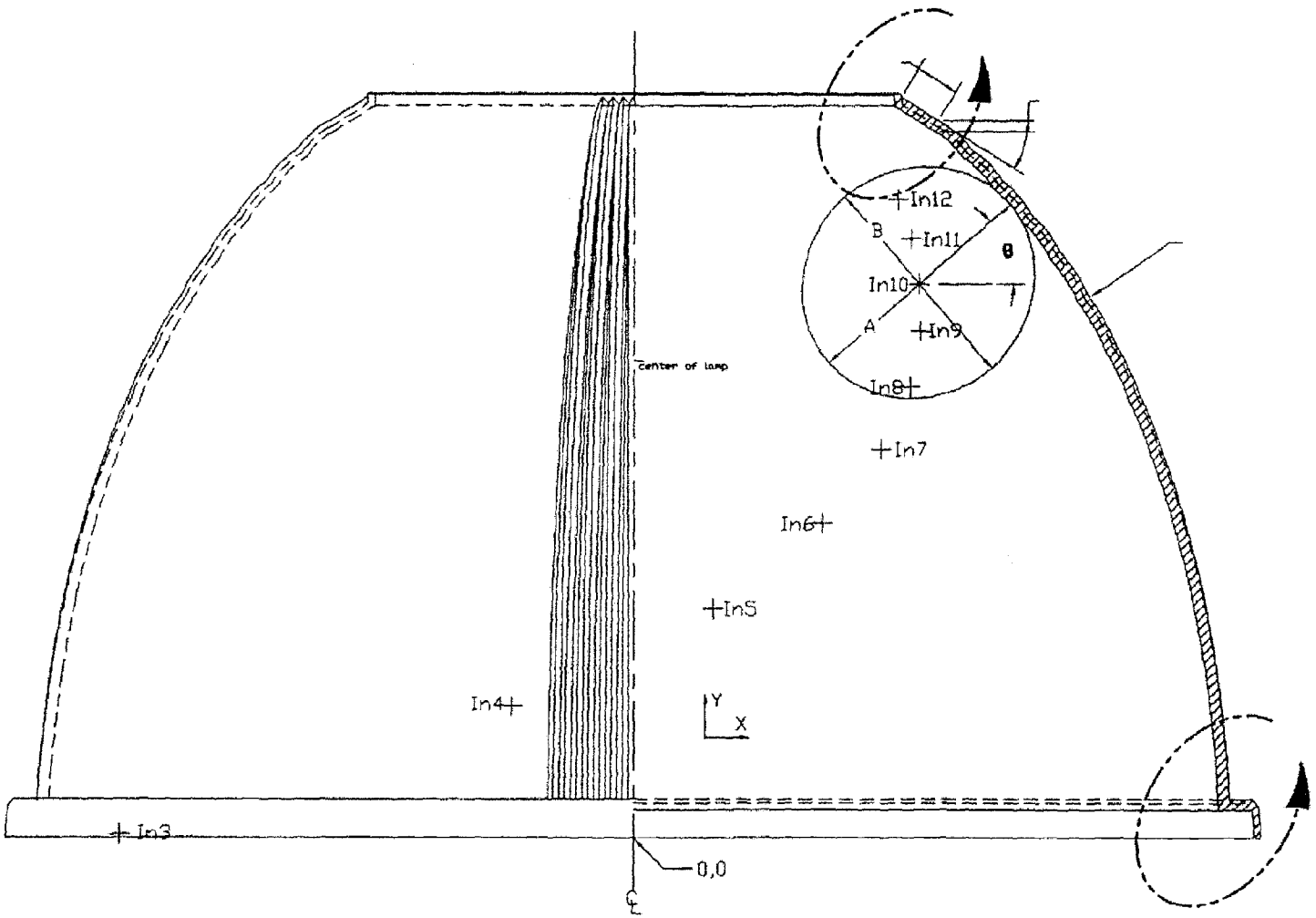
FIG. 13 is a side schematic view of a reflector according to certain aspects of this invention with X and Y axes and other points marked as further explained below for review in connection with Tables 1 and 2.

The ellipse centers are defined in X and Y dimensions from the origin, as shown on FIG. 13. The major and minor axis dimensions of the ellipses are provided and the orientation of the major axis is measured with respect to the positive X axis. The angle θ on FIG. 13 corresponds to the angle between the X axis and the major ellipse axis, measuring counterclockwise as positive. Each table defines either a major prism contour, minor prism contour, or inner surface contour. The point 0,0 is the drawing origin. (Although Tables 1 and 2 include dimensions for In1 (inner surface) and In2, they are not shown on FIG. 13 because they would extend off of the page because the ellipses they define are so large.)

TABLE 1

| Segment # | Center X | Center Y | Major Axis Length (A) | Minor Axis Length (B) | Major Axis Orientation (Θ) |
|---|---|---|---|---|---|
| Inner Surface Elliptical Sections | | | | | |
| In1 | −81.1532 | −12.4951 | 188.4074 | 169.5667 | 8.8792 |
| In2 | −26.3581 | −4.7243 | 77.7934 | 70.1041 | 12.3888 |
| In3 | −9.6666 | −0.8722 | 43.5372 | 39.1835 | 15.7585 |
| In4 | −2.2862 | 1.7813 | 27.8707 | 25.0836 | 19.0276 |
| In5 | 1.4877 | 3.8193 | 19.3787 | 17.4408 | 22.2869 |
| In6 | 3.5402 | 5.4854 | 14.2845 | 12.8561 | 25.5337 |
| In7 | 4.6588 | 6.8981 | 11.0142 | 9.9128 | 28.7602 |
| In8 | 5.2220 | 8.1230 | 8.8136 | 7.9322 | 31.9720 |
| In9 | 5.4314 | 9.2017 | 7.2814 | 6.5533 | 35.1716 |
| In10 | 5.4038 | 10.1632 | 6.1841 | 5.5657 | 38.3701 |
| In11 | 5.2088 | 11.0230 | 5.3866 | 4.8480 | 41.6592 |
| In12 | 5.0471 | 11.9403 | 4.3766 | 3.9389 | 44.7552 |
| Main Prism Ridge Elliptical Sections | | | | | |
| Ma1 | −82.2784 | −12.5298 | 191.0852 | 171.9767 | 8.7961 |
| Ma2 | −26.7427 | −4.7349 | 79.0069 | 71.1062 | 12.2811 |
| Ma3 | −9.8040 | −0.8651 | 44.2524 | 39.8272 | 15.6373 |
| Ma4 | −2.3093 | 1.8010 | 28.3616 | 25.5255 | 18.9043 |
| Ma5 | 1.5278 | 3.8506 | 19.7453 | 17.7708 | 22.1712 |
| Ma6 | 3.6200 | 5.5281 | 14.5718 | 13.1146 | 25.4374 |
| Ma7 | 4.7641 | 6.9518 | 11.2483 | 10.1234 | 28.6952 |
| Ma8 | 5.3437 | 8.1871 | 9.0099 | 8.1089 | 31.9502 |
| Ma9 | 5.5634 | 9.2756 | 7.4496 | 6.7046 | 35.2051 |
| Ma10 | 5.5398 | 10.2449 | 6.3346 | 5.7011 | 38.4694 |
| Ma11 | 5.3448 | 11.1107 | 5.5255 | 4.9730 | 41.8374 |
| Ma12 | 4.9577 | 11.8388 | 5.0925 | 4.5833 | 45.2526 |
| Minor Prism Ridge Elliptical Sections | | | | | |
| Mi1 | −82.0874 | −13.0688 | 190.8605 | 171.7744 | 9.1330 |
| Mi2 | −26.7301 | −5.0460 | 79.0709 | 71.1638 | 12.7270 |
| Mi3 | −9.7695 | −1.0682 | 44.2350 | 39.8115 | 16.1721 |
| Mi4 | −2.2760 | 1.6592 | 28.3032 | 25.4729 | 19.5026 |
| Mi5 | 1.5513 | 3.7461 | 19.6663 | 17.6997 | 22.8097 |
| Mi6 | 3.6307 | 5.4469 | 14.4818 | 13.0336 | 26.0901 |
| Mi7 | 4.7612 | 6.8848 | 11.1524 | 10.0371 | 29.3347 |
| Mi8 | 5.3276 | 8.1277 | 8.9122 | 8.0210 | 32.5491 |
| Mi9 | 5.5354 | 9.2195 | 7.3525 | 6.6173 | 35.7336 |
| Mi10 | 5.5025 | 10.1895 | 6.2385 | 5.6147 | 38.9004 |
| Mi11 | 5.3000 | 11.0543 | 5.4320 | 4.8888 | 42.1409 |
| Mi12 | 4.9963 | 11.8622 | 4.7644 | 4.2879 | 45.2590 |

TABLE 2

| Segment # | Center X | Center Y | Major Axis Length (A) | Minor Axis Length (B) | Major Axis Orientation (Θ) |
|---|---|---|---|---|---|
| Inner Surface Elliptical Sections | | | | | |
| In1 | −79.2400 | −8.3328 | 180.7433 | 162.6690 | 6.6229 |
| In2 | −25.7015 | −3.0801 | 73.2500 | 65.9250 | 10.5653 |
| In3 | −9.3888 | 0.0598 | 40.0339 | 36.0305 | 14.3284 |
| In4 | −2.2400 | 2.3579 | 25.0265 | 22.5239 | 18.1037 |
| In5 | 1.3905 | 4.1898 | 16.9584 | 15.2625 | 21.8998 |
| In6 | 3.3506 | 5.7122 | 12.1519 | 10.9367 | 25.7066 |
| In7 | 4.4094 | 7.0082 | 9.0843 | 8.1759 | 29.5045 |
| In8 | 4.9374 | 8.1263 | 7.0279 | 6.3252 | 33.2954 |
| In9 | 5.1323 | 9.0997 | 5.5975 | 5.0377 | 37.0821 |
| In10 | 5.1078 | 9.9520 | 4.5734 | 4.1160 | 40.8726 |
| In11 | 4.9352 | 10.7040 | 3.8157 | 3.4342 | 44.6535 |
| In12 | 4.8169 | 11.5164 | 2.8131 | 2.5318 | 48.1923 |

TABLE 2-continued

| Segment # | Center X | Center Y | Major Axis Length (A) | Minor Axis Length (B) | Major Axis Orientation (Θ) |
|---|---|---|---|---|---|
| Main Prism Ridge Elliptical Sections | | | | | |
| Ma1 | −80.4929 | −8.3786 | 183.6565 | 165.2909 | 6.5617 |
| Ma2 | −26.1075 | −3.0954 | 74.4716 | 67.0244 | 10.4729 |
| Ma3 | −9.5457 | 0.0586 | 40.7611 | 36.6850 | 14.2160 |
| Ma4 | −2.2815 | 2.3684 | 25.5263 | 22.9737 | 17.9823 |
| Ma5 | 1.4149 | 4.2121 | 17.3280 | 15.5952 | 21.7821 |
| Ma6 | 3.4166 | 5.7470 | 12.4379 | 11.1941 | 25.6043 |
| Ma7 | 4.5024 | 7.0553 | 9.3128 | 8.3815 | 29.4323 |
| Ma8 | 5.0477 | 8.1854 | 7.2154 | 6.4939 | 33.2671 |
| Ma9 | 5.2533 | 9.1702 | 5.7545 | 5.1790 | 37.1115 |
| Ma10 | 5.2344 | 10.0332 | 4.7067 | 4.2360 | 40.9719 |
| Ma11 | 5.0611 | 10.7928 | 3.9365 | 3.5428 | 44.8310 |
| Ma12 | 4.7383 | 11.4207 | 3.4717 | 3.1245 | 48.8377 |
| Minor Prism Ridge Elliptical Sections | | | | | |
| Mi1 | −80.3657 | −8.7666 | 183.4841 | 165.1357 | 6.8108 |
| Mi2 | −26.1146 | −3.3491 | 74.5521 | 67.0969 | 10.8536 |
| Mi3 | −9.5216 | −0.1137 | 40.7517 | 36.6765 | 14.7056 |
| Mi4 | −2.2537 | 2.2459 | 25.4779 | 22.9301 | 18.5562 |
| Mi5 | 1.4369 | 4.1224 | 17.2580 | 15.5322 | 22.4130 |
| Mi6 | 3.4281 | 5.6783 | 12.3563 | 11.1206 | 26.2644 |
| Mi7 | 4.5017 | 6.9997 | 9.2254 | 8.3029 | 30.0870 |
| Mi8 | 5.0347 | 8.1366 | 7.1270 | 6.4143 | 33.8829 |
| Mi9 | 5.2292 | 9.1235 | 5.6676 | 5.1009 | 37.6562 |
| Mi10 | 5.2012 | 9.9853 | 4.6238 | 4.1614 | 41.4120 |
| Mi11 | 5.0216 | 10.7424 | 3.8573 | 3.4716 | 45.1340 |
| Mi12 | 4.7690 | 11.4424 | 3.1896 | 2.8706 | 48.7496 |

FIGS. 4 and 5 also show that both major 34 and minor 36 prisms include an undulating, curved, or elliptical shape as they extend vertically down reflector body 10. This is also shown in more detail by FIG. 8.

Figure 3:
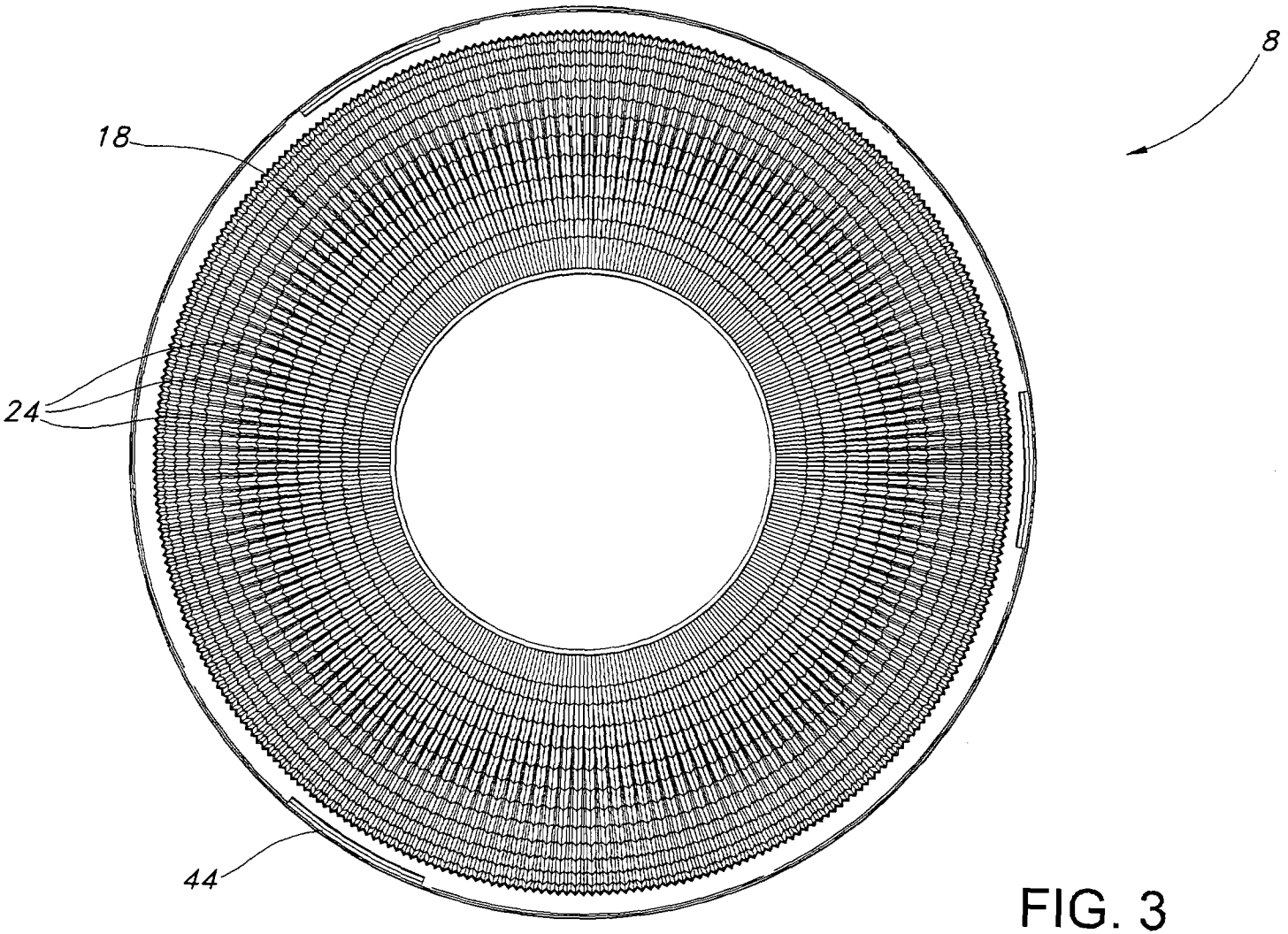
FIG. 3 is a top plan view of the reflector of FIG. 1.

Reflector 10 further includes a lower lip 20 at lower portion 14. Lower lip 20 is disposed at lower portion end 14 and extends substantially around lower portion and defines lower opening 28. Lower lip 20 has planar upper and lower surfaces and a curved annular outer surface. At various portions, lower lip 20 features indentations 44 in upper surface 21. Indentations 44 are provided in order to receive a safety lens made of glass or plastic or a locking door for latching purposes. (For example, the door may enclose the light source for safety purposes.) As shown by FIG. 3, there are preferably three sets of indentations 44 located at approximately 120° degrees around lower lip 20.

In use, the reflector 8 and light source in combination create illumination that extends radially outward of the light source and axially downwardly. The illumination that extends downwardly from the lamp escapes through the reflector body's lower opening 28. The illumination escaping from the light source and extending radially outwardly will be intercepted by a prism 24 on the reflector body 10 so that the majority of light is reflected by total internal prismatic reflection back inside the reflector and downwardly, although some remaining light may be transmitted outwardly. The majority of the light will be scattered inwardly by the segments 40. Light will pass through the segments 40, be intercepted by a prism, and reflected by internal prismatic reflection downwardly and transmitted downwardly by the prisms 24 on the outer surface 18 adjacent the segments 40.

In a specific preferred embodiment, the dimensions of the reflector may be as follows:

| | Possible Ranges | More preferred ranges | Specific ranges for one embodiment | Specific ranges for alternate embodiment |
|---|---|---|---|---|
| Depth | about 12 to 16 inches | About 13 to 15 inches | 13.4 inches | 14.89 inches |
| Upper Opening | about 8 to 11 inches | About 9 to 10 inches | 9.7 inches | 9.7 inches |
| Lower Opening | about 21 to 26 inches | About 22 to 25 inches | 22.8 inches | 25.8 inches |

In a particular embodiment of reflector 8, the uppermost portion 46 is not curved, but is straight and sloped. Although uppermost portion 46 is shown as a substantially continuous slope in FIG. 1, the uppermost portion 46 of alternate reflector embodiments may include a collar that may include various alternate collar geometries or the uppermost portion itself may comprise different geometry, such as L-shaped, Z-shaped, or an extended collar shape.

Moreover, any number of collar configurations could be used to mount the reflector. As those of ordinary skill in the art would realize, collars, if provided, could be any shape and constructed of either specular (mirror-like), diffuse (dispersing, similar to the effect of tissue paper) materials, or anywhere between, i.e. semi-specular or semi-diffuse. All materials fall somewhere between the two extremes.

Those skilled in the art will understand the advantages and disadvantages of providing collars with various reflector designs described herein. Briefly, in some embodiments, a collar is provided in order to gain a greater range in the positioning of the lamp. However, it is not required that the reflector 8 be used in connection with a collar. One disadvantage of providing a collar is that the upwardly-directed light is focused even more precisely and narrowly at nadir when it is directed downward. The segments 40 of the present invention help alleviate these problems, even when the reflector is used in connection with a collar.

As mentioned, the most versatile reflector solution is one that significantly diffuses all light from the upper section of the optic. The diffusion created by the segments 40 of the present invention is primarily in the vertical dimension. Different segment depths can alter the degree of diffusion that results. It is preferable to provide more diffusion near the upper portion 12 of the reflector body 10 than at the lower portion 14. Additionally, however, from an aesthetic standpoint, it is desirable to provide segments 40 the from the upper portion 12 to the lower portion 14 in order to provide lamp obscuration. It is particularly preferred to provide a larger or maximum segment 40 depth at the upper portion 12. Each subsequent segment 40 traversing down the reflector body, becomes increasingly less pronounced until the segment 40 depths reach essentially zero at lower opening 28.

In order to determine segment 40 depths, the inventors applied a linear function, allowing them to enter a single maximum depth and calculate the remaining segment 40 depths from this value. In certain embodiments, segments having too great a depth can cause more light to be reflected back onto the lamp, thereby reducing the efficiency of the fixture, whereas too little depth in the segments 40 results in the "hot spot" problem. An optimally-designed reflector 8 will strike a balance between segment 40 depths, numbers, and sizes.

When the segments 40 are located only on the inside of the reflector, the diffusion effect is somewhat counterbalanced because the light has to pass through the segment 40 twice. The result is that the work that the first segment 40 did to diffuse the light going in is counteracted to some degree when the light exits. Accordingly, in particularly preferred embodiments, both the inside and the outside surface of the reflector include segments 40.

The exterior segment 40 also helps to disperse light that passes through the reflector body 10 in the vertical dimension. This results in the brightness of the luminaire being well-dispersed vertically over the optic when being viewed from the exterior. A design with segments 40 along the entire surface, and particularly, on the outside surface, is more forgiving in terms of providing a broader range of usable light distributions through various lamp types and positions. While not wishing to be bound to any theory, the inventors believe that the diffusing approach tends to be less specific than one that also changes the direction of light travel. Providing segments on the inner surface as well as the outer surface also uses less material than the above-described stepped configuration designs currently available.

Thus, the outwardly curved or undulating segments of this invention achieve optimal light dispersion. With respect to the optical benefit, it is important to understand that it is the proportion of segment depth to length that is critical. For instance, a segment having the same proportion will behave similarly independent of scale. The maximum segment depth-to-length ratio investigated ranged from about 0.02 to about 0.08, and particularly 0.04. Preferably, segment 40 depth to length ratios are 0.05, and even more preferably 0.06 or slightly less than 0.06.

These are the depth to and length ratios that are provided at the deepest curved segment near the top. As discussed, the algorithm used can create progressively shallower curved segments as they extend toward the lower portion 14. However, these examples are provided for reference only. Optically, the segments can be scaled to any size that is appropriate for the size of the reflector. In general, shorter segments with the same depth will have greater dispersing potential than a segment of the same depth that extends over a greater area.

In summary, the degree to which the curved or undulating segments are pronounced can be subtle. It exists on both the interior and exterior surface, although alternatively, it may exist only on the outer surface of the reflector in some embodiments. However, applying curved segments to both sides of the reflector provides the above-described advantages of reducing material required to construct the reflector.

While particular embodiments have been chosen to illustrate the invention, it will be understood by those skilled in the art that various changes and modifications can be made therein without departing from the scope of the invention as defined in the claims.

What is claimed is:

1. A light fixture component adapted for use with a light source, the component comprising:

a bell-shaped body having an azimuthal direction around the body and a vertical direction from an upper to a lower portion of the body, the body comprising a concave inner surface and a convex outer surface, wherein:

the inner surface comprises a plurality of undulations in the vertical direction, with the undulations lessening in pronunciation as they reach the lower portion, and wherein each undulation comprises a band in the azimuthal direction around the inner surface of the body; and the outer surface comprises a plurality of vertically-directed, curvilinear major and minor prisms that define a plurality of undulations in the vertical direction, wherein the undulations are aligned with the plurality of undulations on the inner surface.

2. The light fixture component of claim 1, wherein the plurality of undulations on the inner and outer surfaces are adapted to diffuse light from the light source.

3. The light fixture component of claim 1, wherein the major and minor prisms are ninety-degree prisms.

4. The light fixture component of claim 1, wherein the vertically-directed, curvilinear major and minor prisms define valleys on the outer surface between each prism, and wherein the undulations on the inner surface and the valleys of the outer surface maintain a minimum wall thickness over the bell-shaped body.

5. The light fixture component according to claim 1, wherein the undulations on the inner and outer surfaces comprise curved portions with a maximum curve depth to length ratio from between about 0.02 to about 0.08.

6. The light fixture component according to claim 5, wherein the undulations on the inner and outer surfaces comprise curved portions with a maximum curve depth to length ratio from between about 0.04 to about 0.06.

7. The light fixture component according to claim 5, wherein the undulations on the inner and outer surfaces comprise curved portions with a maximum curve depth to length ratio of greater than 0.05 and slightly less than 0.06.

8. The light fixture component according to claim 1, wherein the undulations on the inner and outer surfaces decrease in depth as they extend down the light fixture component body.

9. The light fixture component of claim 1, wherein the major and minor prisms are provided in a 1:1 ratio.

10. The light fixture component of claim 1, wherein the light fixture component is comprised of a transmissive material with an index of refraction greater than that of air.

11. The light fixture component of claim 10, wherein the light fixture component comprises acrylic.

12. The light fixture component of claim 1, where the light fixture component is adapted to receive a light source disposed within the light fixture component such that the curvilinear prisms reflect light downward through internal prismatic reflection and the undulations on the inner and outer surfaces cooperate to diffuse light from the light source and to prevent the light from concentrating at a center point below the light fixture component.

13. A light fixture component adapted for use with an overhead lighting fixture, comprising:

a curved reflector body comprising:

(a) an inner surface and an outer surface;

(b) the inner surface comprising a plurality of concave undulating segments and the outer surface comprising a plurality of corresponding convex undulating segments, wherein the undulating segments on the inner and outer surfaces become less pronounced as they extend down the reflector body; and (c) the outer surface further comprising a plurality of vertically-directed, curvilinear prisms that define the plurality of convex undulating segments, the prisms adapted to provide internal prismatic reflection of light from the light source.

14. The light fixture component of claim 13, wherein the plurality of vertically-directed, curvilinear prisms define valleys on the outer surface between each prism, and wherein the undulating segments on the inner surface and the valleys of the outer surface maintain a minimum wall thickness over the curved reflector body.

15. The light fixture component of claim 13, wherein the undulating segments on the inner and outer surfaces have the greatest depth near the upper opening and become shallower as they extend toward the lower opening.

16. The light fixture component of claim 13, wherein the undulating segments on the inner and outer surfaces define segments of curves with a radius, the radii of the curves toward an upper portion of the body being smaller than the radii of the curves toward a lower portion of the reflector body, such that the undulating segments on the inner and outer surfaces flatten out as they near the lower portion.

17. A light fixture component adapted for use with an overhead lighting fixture, comprising:

a curved reflector body comprising:

(a) an inner surface; and (b) an outer surface comprising a series of major and minor curvilinear prisms, the curvilinear prisms defining undulating valleys on the outer surface between each prism;

wherein the inner surface and the outer surface of the reflector body comprise a plurality of repeating, aligned, elliptically-curved segments that define the reflector body and maintain a minimum wall thickness between the inner surface and the undulating valleys of the outer surface.

18. The light fixture component of claim 17, wherein the repeating, aligned, elliptically-curved segments define segments of smaller ellipses toward an upper portion of the reflector body and expand to define segments of larger ellipses as the segments extend toward a lower portion of the reflector body.

19. The light fixture component according to claim 17, wherein the repeating, aligned, elliptically-curved segments have maximum depth-to-length ratios from between about 0.02 to about 0.08.

20. The light fixture component according to claim 17, wherein the repeating, aligned, elliptically-curved segments have a greater depth toward an upper portion of the reflector body and a shallower depth toward the lower portion of the reflector body, such that the repeating, aligned, elliptically-curved segments flatten out as they near the lower portion.

21. A light fixture component comprising:

a curved body that defines a major bell-shaped contour of the light fixture component, wherein the major bell-shaped contour is defined by a plurality of directly adjacent minor contours that define elliptical segments over an inner and an outer surface of the light fixture component, wherein the elliptical segments lessen in pronunciation as they extend down the light fixture component and the outer surface comprises at least one prism.

22. The light fixture component of claim 21, further comprising curvilinear major and minor prisms that correspond to the plurality of minor contours defining the elliptical segments on the outer surface.

23. A reflector, comprising a generally bell-shaped body having inner and outer surfaces, wherein:

(a) the inner surface undulates progressing vertically and defines a smooth curve progressing azimuthally and (b) the outer surface undulates progressing vertically generally in consort with the inner surface and forms vertical curvilinear prisms.

* * * * *